US005405214A

United States Patent [19]

Campbell

[11] Patent Number: 5,405,214

[45] Date of Patent: Apr. 11, 1995

[54] PAVING MACHINE INCORPORATING AUTOMATIC FEEDER CONTROL GATES

[75] Inventor: Thomas R. Campbell, Chattanooga, Tenn.

[73] Assignee: Astec Industries, Inc., Chattanooga, Tenn.

[21] Appl. No.: 105,598

[22] Filed: Aug. 12, 1993

[51] Int. Cl.[6] ..... B23B 41/00

[52] U.S. Cl. ..... 404/80; 404/96; 404/105; 404/110

[58] Field of Search ..... 404/80, 81, 96, 101, 404/102, 105, 108, 110, 118, 127; 94/40, 44, 45, 46

[56] References Cited

U.S. PATENT DOCUMENTS 3,453,939 7/1969 Pollitz et al. .

3,699,855 10/1972 Leister .

OTHER PUBLICATIONS

Roadtec, *Roadtec Paver*, RP-180, *Self Propelled Hot Mix Asphalt Paving Machine*, Jan. 1992.

Roadtec, *Roadtec Paver*, RP-185, *Self Propelled Hot Mix Asphalt Paving Machine*, Jan. 1992.

*Primary Examiner*—Ramon S. Britts

*Assistant Examiner*—Pamela A. O'Connor

*Attorney, Agent, or Firm*—Nilles & Nilles

[57] ABSTRACT

A paving machine employs at least one gate mechanism which can selectively alter the weighting of the flow of paving materials from the discharge opening of a hopper by adjusting the contour of the effective lower edge of the gate mechanism. This contour is preferably adjusted by forming the gate mechanism from front and rear vertically adjustable gates, the lower edges of which have opposed tapers. The discharge of materials from the opening is weighted towards one side when the front gate is raised and the rear gate lowered or partially lowered, and is weighted towards the other side when the rear gate is raised and the front gate lowered or partially lowered. Discharge may be prevented altogether by fully lowering both gates.

15 Claims, 3 Drawing Sheets

PAVING MACHINE INCORPORATING AUTOMATIC FEEDER CONTROL GATES

BACKGROUND OF THE INVENTION

1. Field of the Invention

The invention relates to paving machines and, more particularly, relates to paving machines having hoppers for storing paving materials and having vertically adjustable gates for controlling the discharge of paving materials from the hoppers.

2. Discussion of the Related Art

Machines for paving asphalt or the like are well known and typically include a front storage hopper in which asphalt or other suitable paving materials are stored and which has at least one discharge opening for discharging the paving materials to a spreader and an associated screed. Flow of materials from the discharge opening is controlled by a vertically adjustable gate mechanism positioned at the discharge opening of the hopper. The position of the gate mechanism determines the effective width of the opening and thus the thickness of the materials discharged from the hopper.

The typical gate mechanism of the type described above is incapable of adjusting the gradient of the channels of materials being fed to the spreader. This incapability may prove disadvantageous in many circumstances. For example, the typical paving machine requires the use of two adjacent feeder chains in the hopper to feed materials to the adjacent discharge openings of the hopper. These feeder chains are necessarily spaced from one another by a distance which results in the delivery of materials to the spreader in parallel windrows or channels having a gap formed therebetween. The spreader is often incapable of completely compensating for this gap, thus resulting in a low spot in the center of the mat formed by the machine. This problem could be avoided or at least alleviated by supplying the materials to the spreader in channels which increase in cross section from the outboard to inboard sides, thus weighting the delivery of materials towards the gap formed between the two channels and facilitating the even distribution of materials by the spreader. However, state of the art paving machines are incapable of providing such a weighted delivery. Even if discharge openings and/or the gates of the typical paving machine were modified to weight the flow of materials towards one side or the other of the opening, the thus modified machine still would be incapable of altering this weighting to meet changing operating conditions.

OBJECTS AND SUMMARY OF THE INVENTION

It is therefore an object of the invention to provide a paving machine which is capable of providing a weighted flow of paving materials to a spreader and of altering this weighting to meet changing operating conditions.

In accordance with a first aspect of the invention, this object is achieved by employing a gate mechanism which controls the flow of materials from the discharge opening of the hopper to the spreader and which presents a lower edge, the contour of which is adjustable to adjust the effective shape of the discharge opening and thus to adjust the cross-sectional shape of materials being discharged from the opening.

Another object of the invention is to provide a method of controlling the discharge of materials from the discharge opening of the hopper of a paving machine so as to selectively weight the flow of materials out of one portion or another of the discharge opening.

In accordance with another aspect of the invention, this object is achieved by selectively adjusting the effective cross-sectional shape of the discharge opening as the materials are discharged from the hopper by adjusting the contour of an effective upper edge of the opening.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT RESUME

Figure 1:
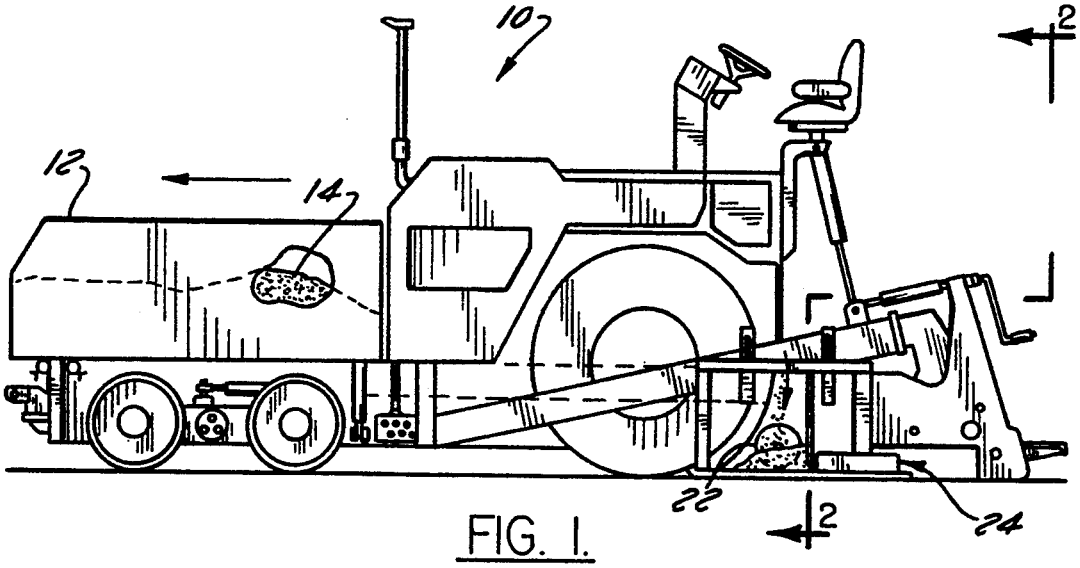
FIG. 1 is a side-elevation view of a paving machine employing gate mechanisms constructed in accordance with the preferred embodiment of the invention.
Figure 2:
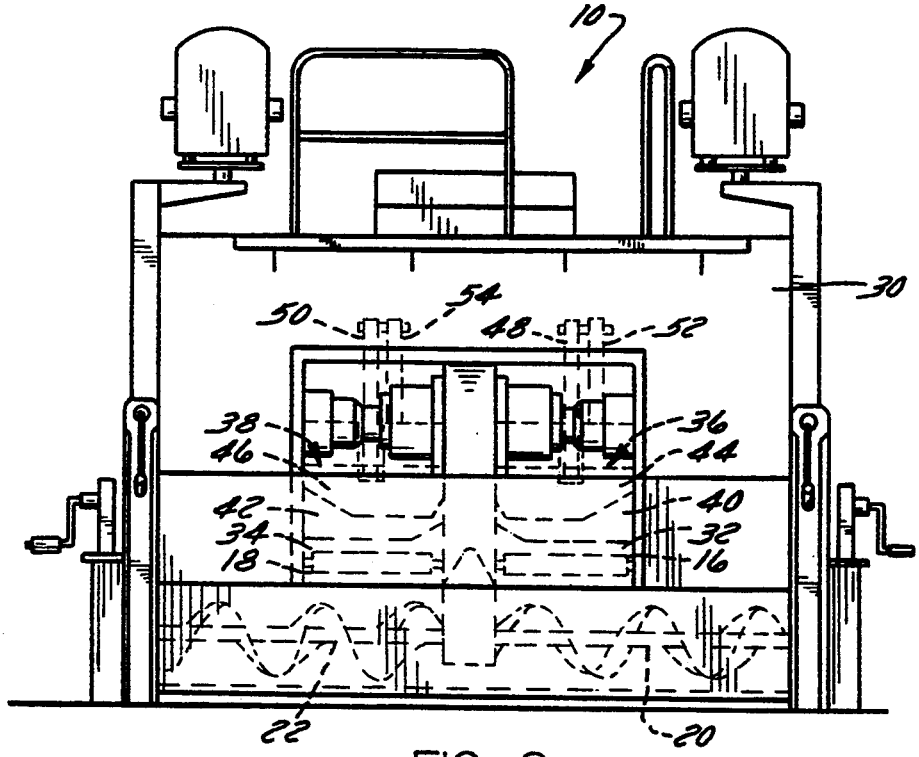
FIG. 2 is a sectional-end view taken along the lines 2—2 in FIG. 1.
Figure 3:
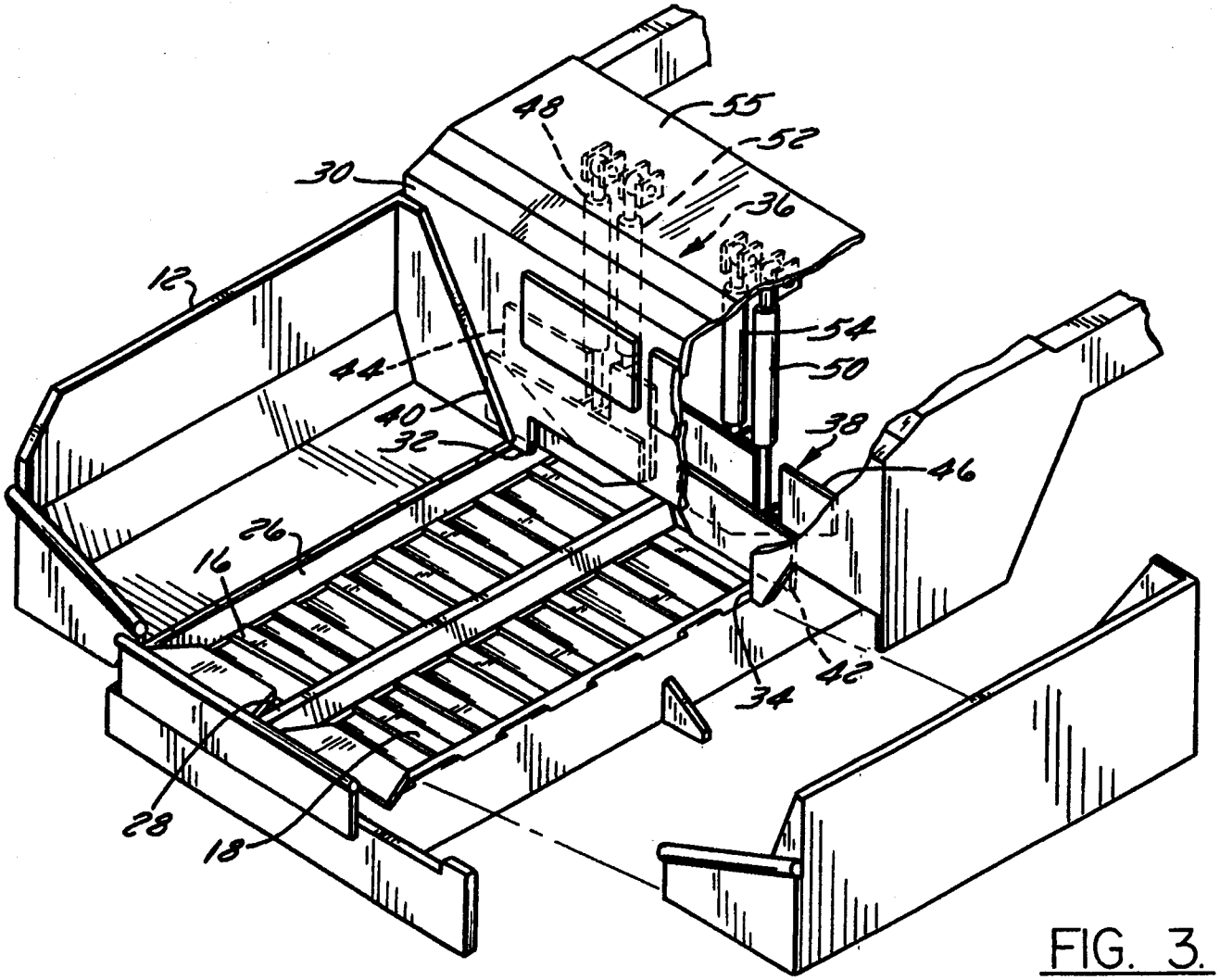
FIG. 3 is a partially exploded perspective view of a portion of the paving machine illustrated in FIGS. 1 and 2.

Pursuant to the invention, a paving machine employs at least one gate mechanism which can selectively alter the weighting of the flow of paving materials from the discharge opening of a hopper by adjusting the contour of the effective lower edge of the gate mechanism. This contour is preferably adjusted by forming the gate mechanism from front and rear vertically adjustable gates, the lower edges of which have opposed tapers. The discharge of materials from the opening is weighted towards one side when the front gate is raised and the rear gate lowered or partially lowered, and is weighted towards the other side when the rear gate is raised and the front gate lowered or partially lowered. Discharge may be prevented altogether by fully lowering both gates.

Construction and Operation of Paving Machine Employing Adjustable Gates

Referring now to the drawings, a paving machine 10 constructed in accordance with the preferred embodiment of the invention includes a storage hopper 12 in which is stored a paving material 14 such as asphalt or an aggregate. Feeder chains 16 and 18 are positioned in the hopper 12, and auger type spreaders 20 and 22 and a heated vibratory screed 24 are located behind the hopper 12. The feeder chains 16 and 18 extend longitudinally along the floor 26 of hopper 12 and flank a shield 28 which directs materials 14 onto the flights of the feeder chain 16 and 18. This shield bisects an aperture formed in the rear end wall 30 of hopper 12 to define first and second discharge openings 32 and 34 in the hopper 12.

In use, materials 14 are fed to the discharge openings 32 and 34 in the hopper 12 by feeder chains 16 and 18 and then discharged from the discharge openings 32 and 34 in windrows or channels the depths of which are determined by the discharge rates of materials from the openings and the rate of forward movement of the paving machine 10. These channels are then levelled by spreaders 20 and 22 before being worked into a mat by the screed 24. The construction and operation of the asphalt paving machine 10 as thus far described are, per se, well known and thus will not be described in greater detail.

Pursuant to the invention, the delivery of materials from each of the discharge openings 32 and 34 can be weighted by a variable amount to meet the operational requirements of the paving machine. This weighting is achieved by adjusting the contour of the effective upper edges of the openings 32 and 34 via operation of laterally adjacent gate mechanisms 36 and 38. Each gate mechanism 36, 38 includes a front gate 40, 42, a rear gate 44, 46, and means 48, 50, and 52, 54 for raising and lowering the front and rear gates independently of one another. The lower edges of the front and rear gates of each of the gate mechanisms 36 and 38 have different contours such that the contour of the effective lower edge of each gate mechanism and thus of the effective upper edge of the respective opening is determined by the relative positions of the front and rear gates. The means for raising and lowering may comprise hydraulic lift cylinders suspended from the paving machine chassis 55 as illustrated, or may comprise electric screw jacks, pneumatic piston and cylinder arrangements, or any mechanism capable of independently raising and lowering the gates upon demand. In the illustrated embodiment, notches 56 and 58 are formed in the rear gates 44 and 46 to permit unobstructed passage of the lift cylinders 48 and 50 for the front gates 40 and 42.

The different contours of the front and rear gates of each of the gate mechanisms 36 and 38 preferably result from opposed tapers on the bottom edges of the front and rear gates. More specifically, each of the front gates 40, 42 has an inner portion 60, 62 which is tapered downwardly from inboard to outboard ends thereof, and each of the rear gates 44 or 46 has an outer portion 64, 66 which is tapered upwardly from inboard to outboard ends thereof. To permit lowering of the rear gates 44 and 46 without interference from the shield 28, an inner portion 68, 70 of the lower edge of each of these gates is tapered downwardly from inboard to outboard edges thereof at an angle generally equal to that of the legs of the triangular shield 28.

Figure 4:
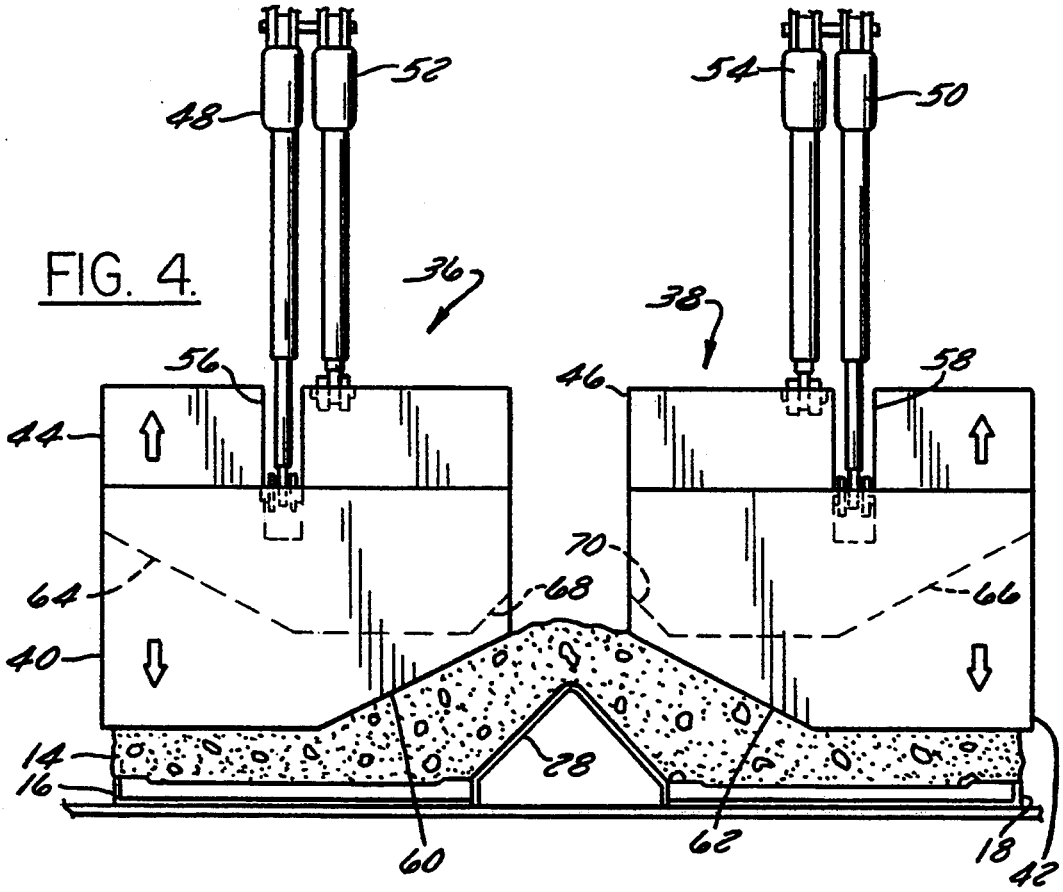
FIG. 4 is an end-view of the gate mechanisms of FIGS. 1–3 with the associated gate mechanisms in first operative positions.
Figure 5:
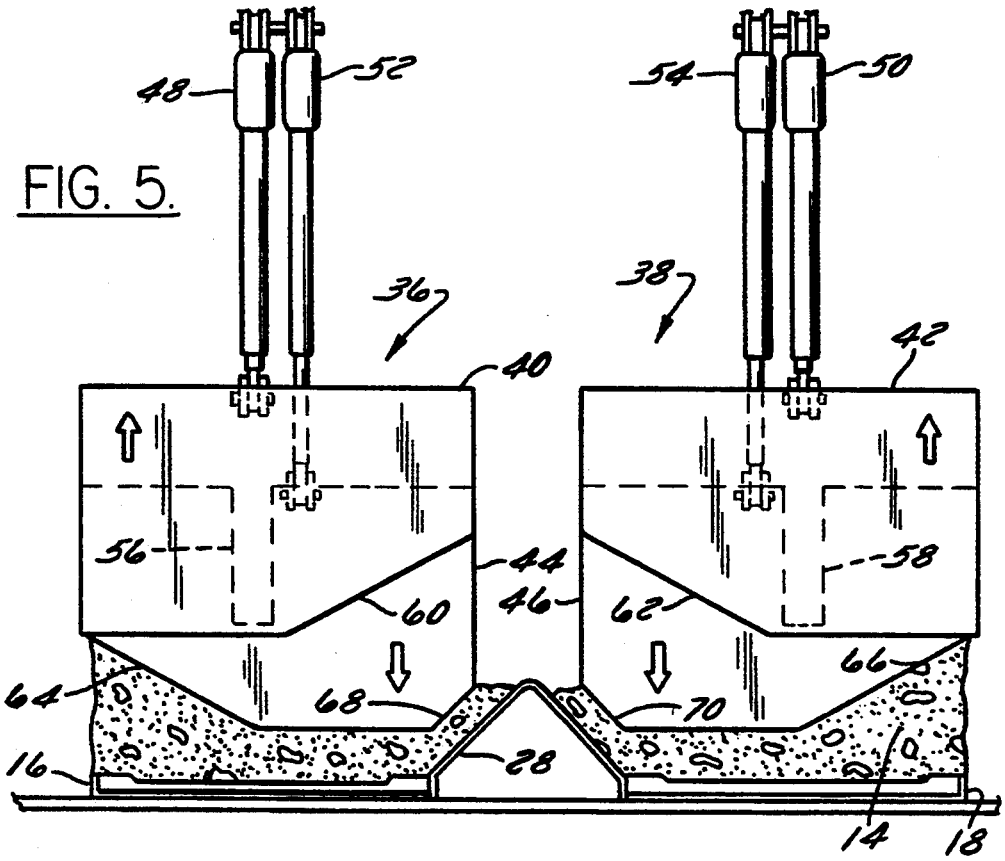
FIG. 5 is an end-view of the gate mechanisms of FIGS. 1–3 with the associated gates mechanisms in second operative positions.

In use, when the front gates 40, 42 are lowered and the rear gates 44, 46 raised as illustrated in FIG. 4 to present an effective lower edge having a first contour, discharge of paving materials 14 will be weighted towards the inboard side of the feeder chains 16 and 18 due to the increased thickness of materials deposited onto the inboard sides of the chains. Weighting the delivery of materials in this manner will thus result in the depositing of more materials adjacent the gap formed between the feeder chains 16 and 18, thus facilitating filling of this gap by the spreader augers 20 and 22. Conversely, when the rear gates 44, 46 are lowered and the front gates 40, 42 raised as illustrated in FIG. 5 to present an effective lower edge having a second contour, discharge of materials 14 will be weighted towards the outer edges of feeder chains 16 and 18.

The use of a pair of independently vertically adjustable gates in each of the gate mechanisms 36 and 38 permits a variety of gate placements in addition to those described above and illustrated in FIGS. 4 and 5. For instance, both gates of either or both of the mechanisms 36, 38 could be closed completely to prevent the discharge of materials from the respective opening 32, 34. Alternatively, both gates of either gate mechanism could be closed only part way to provide decreased weighting of the discharge of materials from one side or the other of the opening or even no weighting at all.

Many changes and modifications could be made to the present invention without departing from the spirit and scope thereof. For example, the lower edges of the gates need not take the shape illustrated but could instead be tapered in any manner which permits the positioning of gates in relation to one another to provide a desired discharge characteristic. The gates need not be employed with the type of paving machine illustrated but could be employed with virtually any paving machine in which adjustment of the discharge characteristics of materials from the hopper is desired. Other changes and modifications which could be made to the invention without departing from the spirit or scope thereof will become more readily apparent from the appended claims.

I claim:

1. A paving machine comprising:

a. a hopper having first and second laterally adjacent discharge openings formed therein; and b. first and second laterally adjacent gate mechanisms, each of which controls the flow of materials from one of said discharge openings of said hopper, each of said gate mechanisms being raisable and lowerable and presenting an effective lower edge having a contour which is adjustable at any given height of the gate mechanism.

2. A paving machine comprising:

a. a hopper having a discharge opening formed therein; and b. a gate mechanism which controls the flow of materials from said discharge opening of said hopper, said gate mechanism presenting an effective lower edge having an adjustable contour, wherein said gate mechanism includes front and rear vertically adjustable gates, said gates having lower edges of different contours which cooperate to form said effective lower edge.

3. A paving machine as defined by claim 2, further comprising means for adjusting the heights of said front and rear gates.

4. A paving machine as defined by claim 2, wherein a portion of said lower edge of one of said front and rear gates is tapered downwardly from inboard to outboard ends thereof and a portion of said lower edge of the other of said front and rear gates is tapered upwardly from inboard to outboard ends thereof.

5. A paving machine as defined by claim 2, wherein said gate mechanism comprises a first gate mechanism-,and further comprising a second gate mechanism spaced laterally from said first gate mechanism, said second gate mechanism presenting an effective lower edge having an adjustable contour and including front and rear vertically adjustable gates, said gates of each of said first and second gate mechanisms having lower edges which cooperate to form the effective lower edge of the respective gate mechanism and at least portions of which have opposing tapers.

6. A paving machine as defined by claim 5, wherein a portion of said lower edge of one of said front and rear gates of each of said first and second gate mechanisms is tapered downwardly from inboard to outboard ends thereof and a portion of said lower edge of the other of said front and rear gates of each of said first and second gate mechanisms is tapered upwardly from inboard to outboard edges thereof.

7. A paving machine as defined by claim 6, further comprising a generally triangular shield which is positioned between said first and second gate mechanisms, and wherein another portion of said lower edge of said other gate of each of said first and second gate mechanisms is positioned adjacent said triangular member and is tapered downwardly from inboard to outboard ends thereof to permit unobstructed lowering of said other gate.

8. A method of controlling the discharge of materials from first and second laterally adjacent discharge openings of the hopper of a paving machine, said method comprising:

selectively adjusting the effective cross-sectional shape of each of said discharge openings, at any given average thickness thereof, by adjusting the contour of an effective upper edge of each of said discharge openings.

9. A method of controlling the discharge of materials from a discharge opening of the hopper of a paving machine, said method comprising:

selectively adjusting the effective cross-sectional shape of said discharge opening as said materials are discharged from said hopper by adjusting the contour of an effective upper edge of said discharge opening, wherein said step of selectively adjusting comprises raising and lowering front and rear gates of a gate mechanism located adjacent said discharge opening, said front and rear gates having lower edges at least portions of which have different contours.

10. A method as defined by claim 9, wherein said step of selectively adjusting comprises raising one of said front and rear gates and lowering the other of said front and rear gates to provide a flow of materials of an increased cross section near an outboard side of said discharge opening.

11. A method as defined by claim 9, wherein said step of selectively adjusting comprises raising one of said front and rear gates and lowering the other of said front and rear gates to provide a flow of materials of an increased cross section near an inboard side of said discharge opening.

12. A method as defined by claim 9, wherein said discharge opening comprises a first discharge opening and said gate mechanism comprises a first gate mechanism, and further comprising the step of selectively adjusting the flow of materials out of a second discharge opening located beside said first discharge opening by raising and lowering front and rear gates of a second gate mechanism located adjacent said second discharge opening, said front and rear gates of said second gate mechanism having lower edges at least portions of which have different contours.

13. A method as defined by claim 12, wherein said step of selectively adjusting comprises lowering both said front and rear gates of at least one of said gate mechanisms to close the respective discharge opening.

14. A method as defined by claim 9, wherein said step of selectively adjusting comprises lowering both said front and rear gates of said gate mechanism to close said discharge opening.

15. A paving machine comprising:

a. a hopper having first and second discharge openings formed therein;

b. first and second feed chains conveying paving materials out of said first and second discharge openings in first and second channels;

c. a triangular shield positioned between said first and second feed chains;

d. first and second spreaders which distribute said first and second channels into a uniform layer;

e. a heated vibratory screed which heats and compresses said layer to form a mat; and f. first and second gate mechanisms which control the flow of materials from said discharge openings of said hopper, each of said gate mechanisms including i. front and rear vertically adjustable gates, an inner portion of the lower edge of one of said front and rear gates being tapered downwardly from inboard to outboard ends thereof, an outer portion of the lower edge of the other of said front and rear gates being tapered upwardly from inboard to outboard ends thereof, and an inner portion of said lower edge of said other gate of each of said first and second gate mechanisms being positioned adjacent said triangular member and being tapered downwardly from inboard to outboard ends thereof to permit unobstructed lowering of said other gate, and ii. means for independently raising and lowering said front and rear gates.

* * * * *